US009975656B2

(12) United States Patent
Smith et al.

(10) Patent No.: US 9,975,656 B2
(45) Date of Patent: May 22, 2018

(54) METHOD OF MANUFACTURING A PISTON AEROSOL DISPENSER

(71) Applicant: The Procter & Gamble Company, Cincinnati, OH (US)

(72) Inventors: Scott Edward Smith, Cincinnati, OH (US); William Mercer Benson, Harrison, OH (US); Andrew William Franckhauser, Batavia, OH (US); Stefano Bartolucci, Riccione (IT)

(73) Assignee: The Procter & Gamble Company, Cincinnati, OH (US)

( * ) Notice: Subject to any disclaimer, the term of this patent is extended or adjusted under 35 U.S.C. 154(b) by 448 days.

(21) Appl. No.: 14/742,790

(22) Filed: Jun. 18, 2015

(65) Prior Publication Data

US 2016/0368633 A1 Dec. 22, 2016

(51) Int. Cl.

| | |
|---|---|
| ***B65B 31/00*** | (2006.01) |
| ***B65D 83/38*** | (2006.01) |
| ***B65D 83/64*** | (2006.01) |

(52) U.S. Cl.

CPC ..... *B65B 31/003* (2013.01); *B65D 83/38* (2013.01); *B65D 83/64* (2013.01)

(58) Field of Classification Search

CPC ..... B65B 31/003; B65B 31/10; B65D 83/42; B65D 83/64

USPC ..... 53/470, 266.1, 284.5; 222/389

See application file for complete search history.

(56) References Cited

U.S. PATENT DOCUMENTS

| | | | | |
|---|---|---|---|---|
| 2,863,699 | A | 12/1958 | Elser | |
| 2,895,650 | A * | 7/1959 | Mahon et al. | B65D 83/64 222/387 |
| 3,020,688 | A * | 2/1962 | Modderno | B65D 83/62 53/425 |
| 3,117,699 | A * | 1/1964 | Epstein | B65B 31/10 222/389 |
| 3,128,922 | A * | 4/1964 | Kuster | B65B 31/003 222/389 |
| 3,216,463 | A * | 11/1965 | Kibbel, Jr. et al. | B65D 83/64 141/3 |
| 3,312,378 | A | 4/1967 | Featherstone et al. | |
| 3,333,743 | A | 8/1967 | Meyers | |

(Continued)

FOREIGN PATENT DOCUMENTS

| | | |
|---|---|---|
| FR | 370458 A | 2/1907 |
| FR | 2686058 A1 | 7/1993 |

(Continued)

OTHER PUBLICATIONS

EPO machine translation of FR370458, retrieved from espacenet.com, Oct. 30, 2017, 5 pages.*

(Continued)

*Primary Examiner* — Stephen F Gerrity
(74) *Attorney, Agent, or Firm* — Larry L. Huston

(57) ABSTRACT

A method of making an outer container for an aerosol dispenser and an aerosol dispenser usable with the outer container. The outer container has an upper container portion and complementary lower container portion. A piston is slideably disposed in the upper container portion. The upper container portion and lower container portion are placed proximate to each other. Propellant is disposed into the lower container portion, then the two portions are joined together at a seal.

17 Claims, 3 Drawing Sheets

(56) References Cited

U.S. PATENT DOCUMENTS

| | | | | |
|---|---|---|---|---|
| 3,403,804 | A | 10/1968 | Colombo | |
| 3,433,134 | A | 3/1969 | Vellekoop | |
| 3,450,254 | A | 6/1969 | Miles | |
| 3,756,476 | A | 9/1973 | Bonduris | |
| 3,827,607 | A | 8/1974 | Schultz | |
| 4,108,219 | A * | 8/1978 | Shulsinger | B65D 83/64 141/20 |
| RE30,093 | E | 9/1979 | Burger | |
| 4,211,344 | A * | 7/1980 | Stoody | B65D 83/42 141/20 |
| 4,234,108 | A | 11/1980 | Diamond | |
| 4,330,066 | A | 5/1982 | Berliner | |
| 4,340,155 | A * | 7/1982 | Obrist | B65D 83/42 222/135 |
| 4,641,765 | A | 2/1987 | Diamond | |
| 4,703,875 | A | 11/1987 | Malek | |
| 4,913,323 | A | 4/1990 | Scheindel | |
| 4,979,652 | A * | 12/1990 | Saulle | B65D 83/42 137/853 |
| 5,000,356 | A | 3/1991 | Johnson et al. | |
| 5,127,556 | A | 7/1992 | Sporri | |
| 5,183,185 | A | 2/1993 | Hutcheson et al. | |
| 5,301,851 | A * | 4/1994 | Frutin | B65D 83/62 222/386.5 |
| 5,522,526 | A * | 6/1996 | DeLaforcade et al. | B65D 83/64 222/1 |
| 6,019,252 | A | 2/2000 | Benecke et al. | |
| 6,230,943 | B1 | 5/2001 | Miyamoto et al. | |
| 6,254,820 | B1 | 7/2001 | Cornell | |
| 6,332,482 | B1 * | 12/2001 | Runge et al. | B65D 83/64 141/20 |
| 6,343,713 | B1 | 2/2002 | Abplanalp | |
| 6,588,628 | B2 | 7/2003 | Abplanalp et al. | |
| 6,708,852 | B2 | 3/2004 | Blake | |
| 6,745,920 | B2 | 6/2004 | Gupta | |
| 7,028,866 | B2 | 4/2006 | Kunesh et al. | |
| 7,182,227 | B2 | 2/2007 | Polle et al. | |
| 7,225,839 | B2 | 6/2007 | Mackenzie et al. | |
| 7,303,087 | B2 | 12/2007 | Flashinski et al. | |
| 8,088,085 | B2 | 1/2012 | Thiebaut et al. | |
| 8,096,327 | B2 | 1/2012 | Hirz | |
| 8,245,888 | B2 | 8/2012 | Andersen et al. | |
| 8,353,845 | B2 | 1/2013 | McCawley et al. | |
| 8,631,970 | B2 | 1/2014 | Chan et al. | |
| 8,869,842 | B2 | 10/2014 | Smith | |
| 8,905,271 | B2 | 12/2014 | Maas et al. | |
| 2002/0027146 | A1 | 3/2002 | De Laforcade | |
| 2008/0054020 | A1 * | 3/2008 | Pierson et al. | B65D 83/64 222/135 |
| 2008/0272128 | A1 * | 11/2008 | Norimatsu et al. | H01M 8/04208 222/389 |
| 2009/0014679 | A1 | 1/2009 | Hygema et al. | |
| 2010/0178429 | A1 | 7/2010 | Presley | |
| 2011/0248035 | A1 | 10/2011 | Peirsman et al. | |
| 2012/0024911 | A1 * | 2/2012 | Obrist | B65D 83/64 222/389 |
| 2012/0291912 | A1 * | 11/2012 | Smith | B65B 31/003 141/3 |
| 2016/0280449 | A1 * | 9/2016 | Mekata et al. | B65D 83/64 |

FOREIGN PATENT DOCUMENTS

| | | | | |
|---|---|---|---|---|
| GB | 2096245 | A * | 10/1982 | B65D 83/64 |
| GB | 2212130 | A | 7/1989 | |
| JP | 2005074974 | A | 3/2005 | |
| WO | WO 91/08099 | | 6/1991 | |
| WO | WO 2007010561 | A1 * | 1/2007 | B65D 83/64 |

OTHER PUBLICATIONS

PCT Search Report PCT/US2016/036277; dated Aug. 23, 2016; 10 Pages.

U.S. Appl. No. 14/742,771, filed Jun. 18, 2015 Scott Edward Smith, et al.

* cited by examiner

METHOD OF MANUFACTURING A PISTON AEROSOL DISPENSER

FIELD OF THE INVENTION

The present invention relates to aerosol dispensers and methods of manufacture thereof.

BACKGROUND OF THE INVENTION

Aerosol dispensers are well known in the art. Aerosol dispensers typically comprise an outer container which acts as a frame for the remaining components and as a pressure vessel for propellant and product contained therein. Outer containers made of metal are well known in the art. However, metal containers can be undesirable due to high cost and limited recyclability. Attempts to use plastic have occurred in the art. Relevant attempts in the art to employ plastic in aerosol dispensers are found in U.S. Pat. Nos. 2,863,699; 3,333,743 and 2009/0014679.

The outer containers are typically, but not necessarily, cylindrical. The outer container may comprise a bottom for resting on horizontal surfaces such as shelves, countertops, tables etc. The bottom of the outer container may comprise a re-entrant portion as shown in U.S. Pat. No. 3,403,804. Sidewalls defining the shape of the outer container extend upwardly from the bottom to an open top.

The open top defines a neck for receiving additional components of the aerosol dispenser. The industry has generally settled upon a neck diameter of 2.54 cm, for standardization of components among various manufacturers, although smaller diameters, such as 20 mm, are also used. Various neck shapes are shown in U.S. Pat. Nos. 6,019,252; 7,303,087 and 7,028,866.

Typically a valve cup is inserted into the neck. The valve cup is sealed against the neck to prevent the escape of the propellant and loss of pressurization, such as described in commonly assigned U.S. Pat. No. 8,869,842 or as described in U.S. Pat. No. 8,096,327. The valve cup holds the valve components which are movable in relationship to the balance of the aerosol dispenser.

For example, a non-aerosol system using an elastically deformable band may be used as described in commonly assigned U.S. Pat. No. 8,631,970. Such a system may dispense a personal care product. Pistons for an aerosol container are disclosed in U.S. Pat. Nos. 3,433,134; 3,827,607; 4,234,108; 5,127,556; and 8,245,888. Other piston devices are shown in U.S. Pat. Nos. 3,312,378; 3,756,476; 4,641,765; 4,913,323; 4,703,875; 5,183,185; 6,230,943; 6,588,628; 6,745,920; 7,225,839; 8,088,085. An elevator with a screw is disclosed in commonly assigned U.S. Pat. No. 5,000,356.

Aerosol dispensers, having a valve cup and movable valve components, may comprise different embodiments for holding, storing, and dispensing product used by the consumer. In one embodiment, the product and propellant are intermixed. When the user actuates the valve, the product and propellant are dispensed together. This embodiment may utilize a dip tube. The dip tube takes the product and propellant mixture from the bottom of the outer container. This embodiment may be used, for example, to dispense shaving cream foams.

Or, a collapsible, flexible bag may be sealed to the opening on the underside of the valve cup or may be placed between the valve cup and the container. This bag limits or even prevents intermixing of the contents of the bag and the components outside of the bag. Thus, product may be contained in the bag. Propellant may be disposed between the outside of the bag and the inside of the outer container. Upon actuation of the valve, a flow path out of the bag is created. This embodiment is commonly called a bag on valve and may be used, for example, in dispensing shaving cream gels. An aerosol container having a bag therein may be made from a dual layer preform, having plural layers disposed one inside the other. Relevant attempts in the art include U.S. Pat. Nos. 3,450,254; 4,330,066; 6,254,820; RE 30093 E; WO 9108099 and US 2011/0248035 A1.

But aerosol container having a bag on valve or dip tube configuration are not well suited to dispense high viscosity products. High viscosity products occur in many forms, such as mousse, toothpaste, caulk, shave gel, body lotion, shampoo, antiperspirant, etc.

A piston configuration may be suited for high viscosity products, and may be used for atomizing aerosol executions as well. In a piston aerosol dispenser, a movable piston is juxtaposed with the bottom of the outer container. As the user operates the actuator, propellant under the piston provides motive force to advance the piston, towards the top of the container, thereby dispensing product.

But, piston dispensers require a bung hole or one way valve in the bottom of the container, for propellant fill and subsequent sealing. But the bung holes and valves provide a path for leakage.

But if the bung hole and valve are eliminated over leakage concerns, a conventional piston dispenser needs egress for air trapped during assembly. If trapped air is not accounted for, full piston travel may not occur. Relevant attempts include U.S. Pat. Nos. 6,343,713; 6,708,852; 7,182,227; 7,225,839; 8,353,845 and 8,905,271.

Accordingly, a new approach is needed.

SUMMARY OF THE INVENTION

The invention comprises a method of making an outer container suitable for an aerosol dispenser and making a respective aerosol dispenser. The method comprising the steps of: providing a lower container portion with a closed end bottom disposed at a first end, the closed end bottom not having a bung hole therethrough, and providing an upper container portion having an open neck at a second end. An axially moveable piston is disposed within the upper container portion. Propellant is disposed in the lower container portion. The upper container portion and lower container portion are joined together at a complementary seal therebetween.

For an aerosol dispenser, a valve assembly may be added to the upper container portion and product disposed through the valve assembly, thereby forcing the piston against the propellant away from the valve assembly.

BRIEF DESCRIPTION OF THE DRAWINGS

The drawings are to scale, unless otherwise noted.

DETAILED DESCRIPTION OF THE INVENTION

Figures 1A, 2A, 2B, 2C:
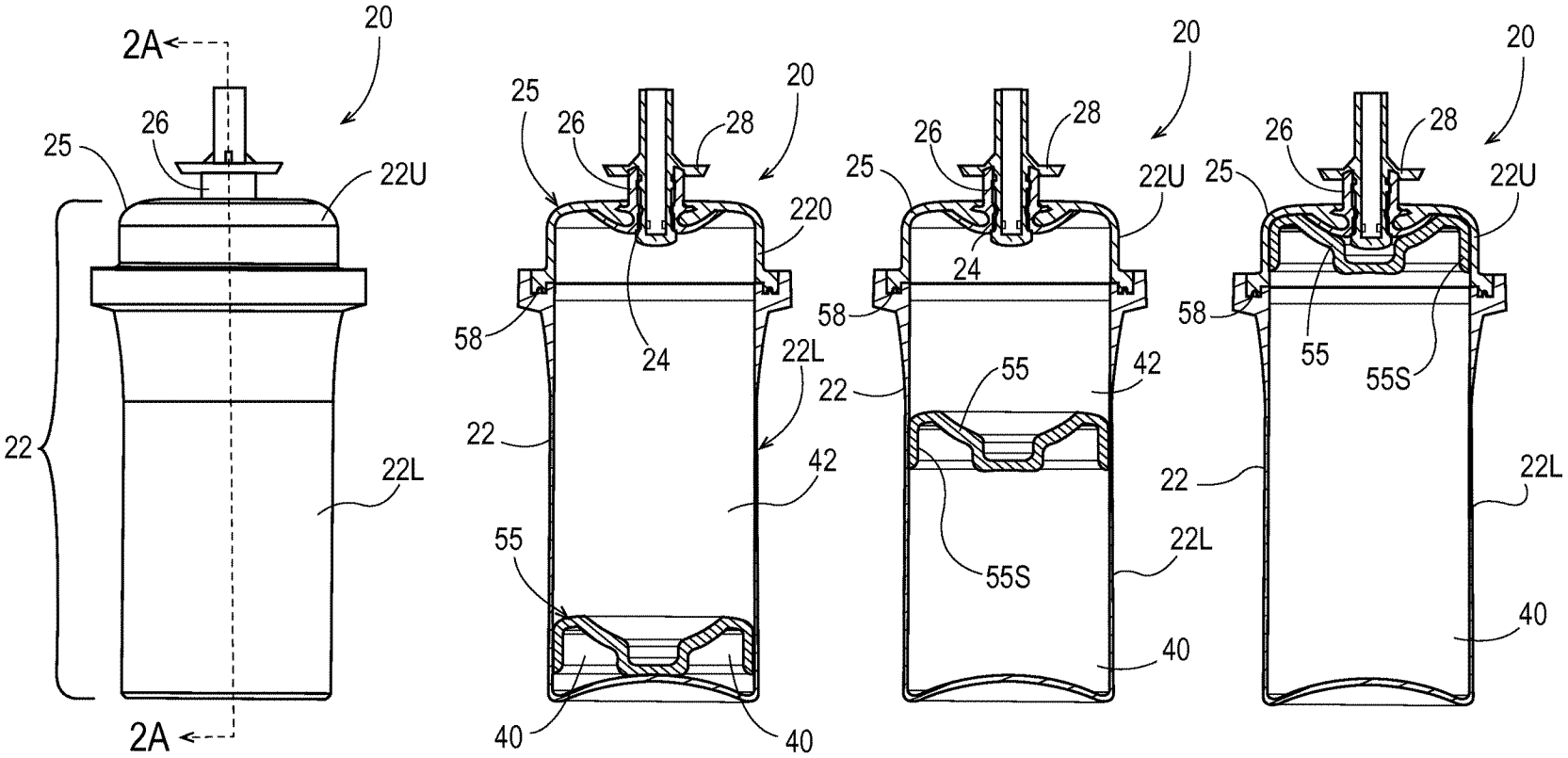
FIG. 1A is a perspective view of an aerosol dispenser according to the present invention.
FIG. 2A is vertical sectional view of the aerosol dispenser of FIG. 1 taken along line 2A-2A and having a piston in the starting position.
FIG. 2B is the aerosol dispenser of FIG. 2A having the piston in an intermediate position.
FIG. 2C is the aerosol dispenser of FIG. 2A having the piston in a final position.
Figure 1C:
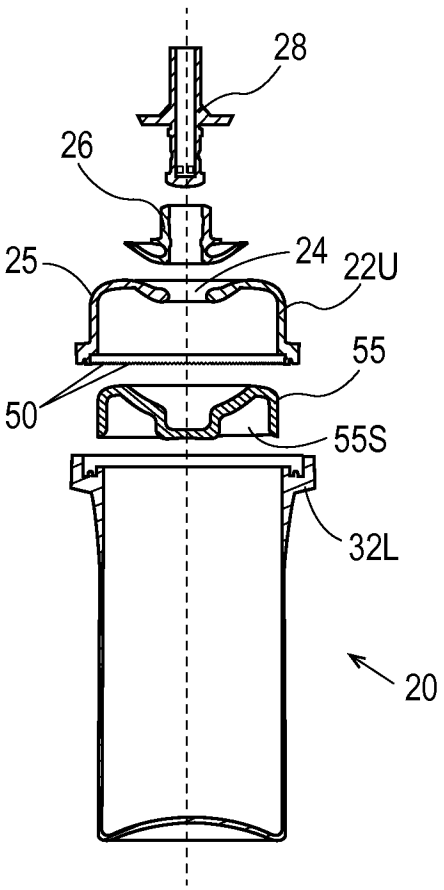
FIG. 1C is a vertical sectional view of the aerosol dispenser of FIG. 1B, taken along line 1C-1C
Figure 1B:
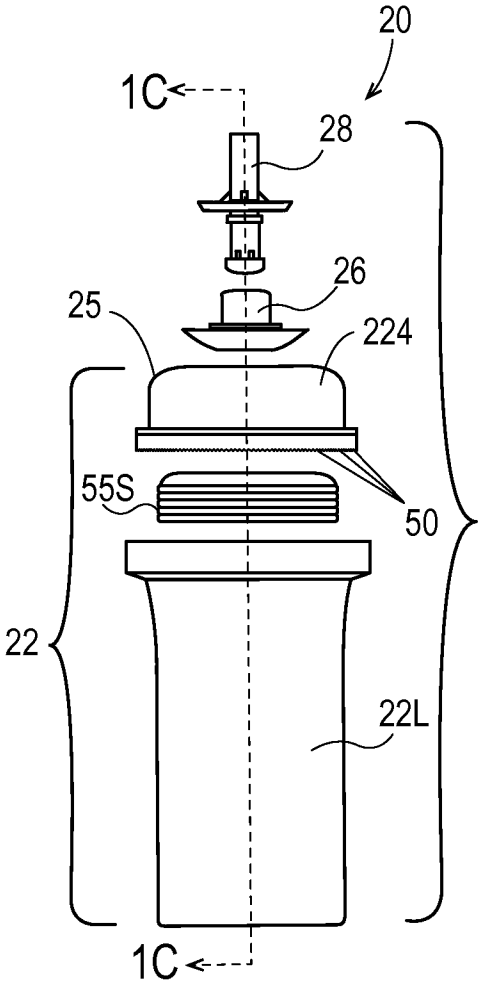
FIG. 1B is an exploded view of the aerosol dispenser of FIG. 1.

Referring to FIGS. 1A, 1B and 1C, an aerosol dispenser 20 having a longitudinal axis is shown. The aerosol dispenser 20 comprises a pressurizeable outer container 22 usable for such a dispenser. The outer container 22 may comprise an upper container portion 22U and lower container portion 22L joined in fluid tight relationship. A piston 55 slidingly fits inside both the upper container portion 22U and lower container portion 22L for axial movement as described below.

The outer container 22 may comprise metal or preferably plastic, as are known in the art. Plastic is preferred, due to occasional denting in metal, which allows to propellant 40 to escape or blocks piston 55 travel. The outer container 22 may have an opening. The opening is typically at the top of the pressurizeable container when the pressurizeable container is in its-in use position. The opening defines a neck 24, to which other components may be sealingly joined.

As the top of the outer container 22 is approached, the outer container 22 may have a neck 24. The neck 24 may be connected to the container sidewall by a shoulder 25. The shoulder 25 may more particularly be joined to the sidewall by a radius. The shoulder 25 may have an annular flat. The neck 24 may have a greater thickness at the top of the outer container 22 than at lower portions of the neck 24 to provide a differential thickness. Such differential thickness may be accomplished through having an internally stepped neck 24 thickness.

A valve cup 26 may be sealed to the opening of the outer container 22, as described in further detail below. The valve cup 26 may be sealed to the neck of the outer container 22 using the class 1 TPE material sold by Kraiburg TPE GmbH & Co KG of Waldkraiburg, Germany under the name Hcc8791-52.

If desired, the valve cup 26 may be sealed to the container utilizing a press fit, interference fit, solvent welding, laser welding, vibration welding, spin welding, adhesive or any combination thereof. An intermediate component, such as a sleeve or connector may optionally be disposed intermediate the valve cup 26 and neck 24 or top of the outer container 22. Any such arrangement is suitable, so long as a seal adequate to maintain the pressure results.

A valve assembly 28, in turn, may be disposed within the valve cup 26. The valve assembly 28 provides for retention of product 42 within the aerosol dispenser 20 until the product 42 is selectively dispensed by a user. The valve assembly 28 may be selectively actuated by an actuator. A nozzle and related valve assembly 28 components may optionally be included, depending upon the desired dispensing and spray characteristics. The valve assembly 28 may be attached using conventional and known means. The valve assembly 28 and actuator may be conventional and do not form part of the claimed invention.

Selective actuation of the valve assembly 28 allows the user to dispense a desired quantity of the product 42 on demand. Illustrative and non-limiting products 42 include shave cream, shave foam, body sprays, body washes, perfumes, cleansers, air fresheners, astringents, foods, paint, etc.

Preferably, the product delivery device comprises a piston 55. The piston 55 slidingly fits closely inside the outer container 22. The sliding fit allows the piston 55 to translate from a proximal or starting position at or near the bottom of the outer container 22 to a distal or finishing position at or near the top of the outer container 22. Movement of the piston 55 from the starting position to the finishing position expels product 42 in a spray from the nozzle.

The aerosol dispenser 20, and components thereof, may have a longitudinal axis, and may optionally be axi-symmetric with a constant round cross section. Alternatively, the outer container 22, piston 55, valve assembly 28, etc., may be eccentric and have a square, elliptical or other constant cross section.

The outer container 22 may comprise a plastic pressurizeable container. The plastic may be polymeric, and particularly comprise PET. The valve assembly 28, and optional valve cup 26 may be joined to the neck 24 of the outer container 22 in known fashion.

Any number of known valve assemblies may be usable with the present invention. One suitable and non-limiting example, is shown. In this example, a rigid sleeve may be attached to the top of the bag with an impermeable seal. An elastically deformable plug may be tightly inserted into the sleeve. Longitudinal movement of the plug, in the downward direction and within the sleeve may allow product 42 to be selectively dispensed. The sleeve may be impermeably joined to an optional valve cup 26. The valve cup 26, in turn, may be joined to the neck 24 of the outer container 22. A suitable plug and sleeve type valve assembly 28 may be made according to the teachings of commonly assigned U.S. Pat. No. 8,511,522.

The pressurizeable container may further include a propellant 40. The propellant 40 may comprise nitrogen, air and mixtures thereof. Propellant 40 listed in the US Federal Register 49 CFR 1.73.115, Class 2, Division 2.2 are also considered acceptable. The propellant 40 may particularly comprise a Trans-1,3,3,3-tetrafluoroprop-1-ene, and optionally a CAS number 1645-83-6 gas. One such propellant 40 is commercially available from Honeywell International of Morristown, N.J. under the trade name HFO-1234ze or GWP-6.

If desired, the propellant 40 may be condensable. Generally, the highest pressure occurs after the aerosol dispenser 20 is charged with product 42 but before the first dispensing of that product 42 by the user. A condensable propellant 40 provides the benefit of a flatter depressurization curve as product 42 is depleted during usage. A condensable propellant 40 also provides the benefit that a greater volume of gas may be placed into the container at a given pressure.

Referring to FIGS. 1C and 2A-2C, and examining the components in more detail, the pressurizeable container may comprise an outer container 22 having a neck with a valve cup 26 therein or disposable therein. A user activated valve assembly 28 may be disposed in the valve cup 26. A product delivery device may be joined to the valve cup 26. Propellant 40 may be disposed between the bottom of the outer container 22 and the bottom of the piston 55. The propellant 40 may be retained and not dispensed.

If desired, the outer container 22, valve cup 26, valve assembly 28, and/or piston 55 may be polymeric. By polymeric it is meant that the component is formed of a material which is plastic, comprises polymers, and/or particularly polyolefin, polyester or nylons, and more particularly PET. Thus, the entire aerosol dispenser 20 or, specific components thereof, may be free of metal, allowing microwaving. Microwave heating of the aerosol dispenser 20 or pressurizable container therefor provides for heating of the product 42 prior to dispensing. Heating of the product 42 prior to dispensing may be desirable if the product 42 is applied to the skin, becomes more efficacious at lower viscosities, or is to be eaten.

The valve cup 26 may have a valve cup 26 periphery complementary to the neck 24 periphery. At least one of the valve cup 26 and/or container neck 24 may have one or more channels 50 therethrough. Additionally or alternatively, the channels 50 may be formed at the interface between the valve cup 26 and container neck 24. Particularly, the bottom edge of the upper container portion 22U and top edge of the lower container portion 22L are complementary to the other. The channels 50 may be formed by irregularities, such as crenulations, merlins, serrations, notches, teeth, etc. between and on the bottom edge of the upper container portion 22U and/or top edge of the lower container portion 22L The outer container 22, and all other components, except the TPE seal, may comprise, consist essentially of or consist of PET, PEN, Nylon EVOH or blends thereof to meet DOT SP 14223. Such materials may be selected from a single class of recyclable materials, as set forth above by the SPI. The piston 55 may comprise as individual plastic, thermoplastic, elastomers, rubber, silicone, LDE/PET, PET/TPE, PE, PP, nylon and/or compounds or mixtures thereof permitting the desired rigidity and seal performance.

If desired, the outer container 22, and/or piston 55, may be transparent or substantially transparent. This arrangement provides the benefit that the consumer knows when product 42 is nearing depletion and allows improved communication of product 42 attributes, such as color, viscosity, etc. Also, labeling or other decoration of the container may be more apparent if the background to which such decoration is applied is clear.

The outer container 22 may define a longitudinal axis of the aerosol dispenser 20. The outer container 22 may be axisymmetric as shown, or, may be eccentric. While a round cross-section is shown, the invention is not so limited. The cross-section may be square, elliptical, irregular, etc. Furthermore, the cross section may be generally constant as shown, or may be variable. If a variable cross-section is selected, the outer container 22 may be barrel shaped, hourglass shaped, or monotonically tapered.

The outer container 22 may range from 6 to 40 cm in height, taken in the axial direction and from 4 to 60 cm in diameter if a round footprint is selected. The outer container 22 may have a volume ranging from 115 to 1000 cc exclusive of any components therein, such as a product delivery device. The outer container 22 may be injection stretch blow molded. If so, the injection stretch blow molding process may provide a stretch ratio of greater than 8, 8.5, 9, 9.5, 10, 12, 15 or 20.

The outer container 22 may sit on a base. The base is disposed on the bottom of the outer container 22 and of the aerosol dispenser 20. Suitable bases include petaloid bases, champagne bases, hemispherical or other convex bases used in conjunction with a base cup. Or the outer container 22 may have a generally flat base with an optional punt.

The outer container 22 may comprise two or more individual portions, particularly an upper container portion 22U and a lower container portion 22L. Each of the upper container portion 22U and lower container portion 22L may be monolithic and made of a single, integral piece or may be composed of plural pieces assembled together to make the upper container portion 22U or lower container portion 22L, respectively.

The upper container portion 22U may be generally dome-shaped with a concavity underneath, creating volume to congruently receive piston 55. During manufacture and/or at end of product life, the piston 55 may nest inside upper container portion 22U without any portion of the piston 55 extending outwardly therefrom.

The lower container portion 22L may be a generally closed end bottom for the outer container 22. The lower container portion 22L may have a greater longitudinal length than the upper container portion 22U. The lower container portion 22L may comprise at least 10, 20, 30, 40, 50, 60, 70, 80 or 90% of the longitudinal length of the outer container 22 when joined to the upper container portion 22U, as measured on the longitudinal axis. The upper container portion 22U may comprise the balance of the outer container 22.

The upper container portion 22U and lower container portion 22L may be joined at a seal 58. The seal 58 is a fluid tight joint between the upper container portion 22U and lower container portion 22L. While an upper container portion 22U and lower container portion 22L having a seal 58 therebetween disposed near the top of the outer container 22 is shown, one of skill will realize the invention is not so limited. The seal 58 may comprise a circumferential flange disposed outboard of an annular to the walls of the outer container 22, to preserve the inner diameter at constant cross section and not interfere with axial movement of the piston 55 from the lower container portion 22L to the upper container portion 22U. The outboard flange also provides for advantageous disposition of channels 50 for propellant 40 fill as discussed below.

The seal 58 may be disposed at any suitable position between the top and bottom of the outer container 22. It is only necessary that the piston 55 be insertable into one of the lower container portion 22L and preferably the upper container portion 22U and the upper container portion 22U and lower container portion 22L be sealable in fluid type relationship.

The piston 55 may have a top with an annular skirt 55S depending therefrom. The skirt 55S has a depth in the axial direction. The skirt 55S may minimize cocking or off-axis orientation of the piston 55 as it moves within the outer container 22, particularly if any irregularities are encountered as the piston 55 slidably moves across seal 58 from the lower container portion 22L to the upper container portion 22U. The top may congruently fit within and conform to the underside of the upper container portion 22U. The top of the piston 55 may be oriented, or have a central and concentric portion thereof, oriented concave upwardly, towards the valve assembly 28 and be particularly complementary to the valve cup 26.

Preferably the axial dimension of the skirt 55S is less than or equal to the axial dimension of the upper container portion 22U. This relative dimension provides for advantageous propellant charge, as discussed below.

A manifold may supply propellant, under pressure, through at least one channel between the upper container portion 22U and lower container portion 22L. The manifold may be retractingly disposed above the shoulder 25. The manifold may be brought into contact with the shoulder, forming a temporary seal 58 therebetween. Suitable channels are particularly described in commonly assigned U.S. Pat. No. 8,869,842 to Smith at FIG. 8, column 7, lines 57 to column 8, line 2 and column 8, lines 44-60.

While the temporary seal 58 is established between the manifold and shoulder, the propellant 40 may be charged into the upper container portion 22U and/or lower container portion 22L A suitable process for charging the outer container 22 with propellant 40 is described in commonly assigned U.S. Pat. No. 8,869,842 to Smith at FIG. 9 and column 8, lines 15-35.

The outer container 22 may be pressurized to an internal gage pressure of 100 to 1300, 110 to 490 or 270 to 420 kPa. A particular aerosol dispenser 20 may have an initial propellant 40 pressure of 1100 kPA and a final propellant 40 pressure of 120 kPa, an initial propellant 40 pressure of 900 kPA and a final propellant 40 pressure of 300 kPa, an initial propellant 40 pressure of 500 kPA and a final propellant 40 pressure of 0 kPa, etc.

If a permanent seal 58 between the upper container portion 22U and lower container portion 22L is desired, the seal 58 may be welded. Particularly, if the upper container portion 22U and lower container portion 22L are polymeric, and have compatible melt indices, such components may be sealed by welding to retain propellant therein. Suitable welding processes may include sonic, ultrasonic, spin, and laser welding. Welding may be accomplished with a commercially available welder, such as available from Branson Ultrasonics Corp. of Danbury, Conn. Alternatively or additionally, the channel may prophetically be blocked by a plug or sealed by adhesive bonding. Suitable sealing processes are particularly described in commonly assigned U.S. Pat. No. 8,869,842 to Smith at FIG. 9 and column 8, lines 30-43.

If a releasable seal 58 is desired, the seal 58 may be formed with a threaded connection. The threaded connection may be internal to or external to the outer container 22. Particularly, the upper container portion 22U and lower container portion 22L may be releasably threaded together at the seal 58 therebetween.

The outer container 22 sidewall also defines an inside diameter. Preferably inside diameters of the upper container portion 22U and lower container portion 22L are matched so that the piston 55 can move therebetween without difficulty. Particularly, it is important that the piston 55 be able to translate from a proximal position juxtaposed with the base of lower container portion 22L to a distal position juxtaposed with the top of the upper container portion 22U.

Referring to FIG. 2B, and examining the piston 55 in more detail, the piston 55 has two opposed faces, a top face oriented towards the top of container 22 and a generally opposed bottom face oriented towards the bottom of container 22. The piston 55 is sized to slidably fit within the bore of the container 22 while sealing the propellant 40 from the product 42.

Referring to FIG. 2A, the bottom face of the piston 55 is generally concave downward, forming a chamber between the bottom face and the inside of the base of lower container portion 22L. This chamber is used to contain propellant 40. The chamber may be generally annular in shape. This shape is believed to provide radially outward force against the piston 55, to improve congruence and with and minimize leakage between the piston 55 and inside surfaces of the lower container portion 22L/the upper container portion 22U.

The propellant 40 provides motive force for the piston 55 to advance within and from the lower container portion 22L to the upper container portion 22U, and thereby dispense product 42 in response to user demand. The chamber containing the propellant 40 has the smallest volume when the piston 55 is in the starting or proximal position. As the piston 55 advances the propellant 40 chamber enlarges, reducing pressure therein according to Boyles Law.

Referring to FIG. 2C, the upper face of the piston 55 may be congruent to the inside of the top of the upper container portion 22U. This arrangement provides for maximum travel of the piston 55 to the distal or final position. When the top face of the piston 55 is in contact with the underside of the upper container portion 22U, all product 42 therebetween is dispensed, advantageously minimizing any residual product left at the end of the effective life of the aerosol dispenser 20.

If desired, as shown, the upper container portion 22U may be free of and not have a tapered shoulder 25. Such a geometry, coupled with constant cross section, provides the benefit that the piston 55 may freely travel to the top of the upper container 22U, ensuring all product 42 is dispensed.

Figure 3A:
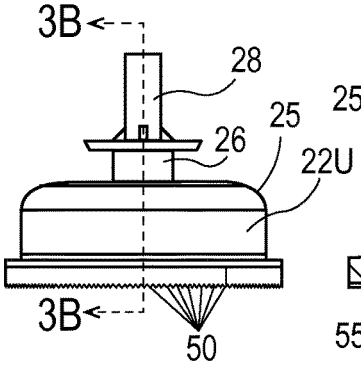
FIG. 3A is view of an upper container portion having a piston nested therein.
Figure 3B:
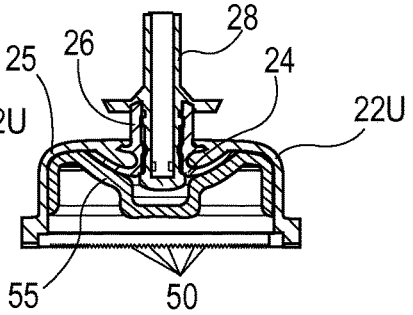
FIG. 3B is a vertical sectional view taken along line 3B-3B of FIG. 3A.

Referring to FIGS. 3A and 3B, the aerosol dispenser 20 may be advantageously manufactured as follows. The piston 55 may be nested, that is removably disposed, in its final position within the upper container portion 22U. The upper container portion 22U is placed proximal to the lower container portion 22L with a channel therethrough.

Propellant 40 is charged through the channel, as described above. Preferably the channel is between the upper container portion 22U and the lower container portion 22L, as described above. The propellant 40 is preferably charged underneath the piston 55 and into the lower container portion 22L or some combination of the lower container portion 22L and upper container portion 22U. Preferably no propellant 40 is charged above the piston 55. After the propellant charge is completed, the channel may be sealed, as described above.

Before or after the channel 50 is sealed, the upper container portion 22U and lower container portion 22L may be joined together, forming a fluid tight seal 58. If the channel 50 is between the upper container portion 22U and lower container portion 22L, sealing of the channel 50 and the upper container portion 22U to the lower container portion 22L may occur in a single step.

After the seal 58 is closed, and the upper container portion 22U and lower container portion 22L are permanently joined together, product 42 may be inserted into the aerosol dispenser. Product 42 fill may occur at the same plant as the propellant 40 charge or at a different manufacturing site.

Particularly, product 42 may be inserted into the upper container portion 22U, through the valve assembly 28 in known fashion. As product 42 enters the upper container portion 22U, the piston 55 is displaced downwardly, towards the base of the lower container portion 22L. Such displacement compresses the propellant 40, increasing pressure according to Boyles Law. Pressure may be ultimately increased to the desired starting pressure for usage conditions.

The aerosol dispenser 20, as presented to a user may have an initial pressure. The initial pressure is the highest pressure encountered for a particular filling operation, and corresponds to no product 42 yet being dispensed from the product delivery device. As product 42 is depleted, the outer container 22 approaches a final pressure. The final pressure corresponds to depletion of substantially all product 42, except for small residual, from the product delivery device. One benefit of the invention is that the residual product, remaining at end of life, is unexpectedly minimized.

This arrangement provides the benefit that propellant 40 may be charged to a lesser pressure than the desired starting pressure, decreasing propellant 40 charge time and reducing pressure applied to the charging machinery. Another benefit is that propellant 40 is disposed in the desired position for the end use when the aerosol dispenser 20 is ready for sale or use.

Figure 4:
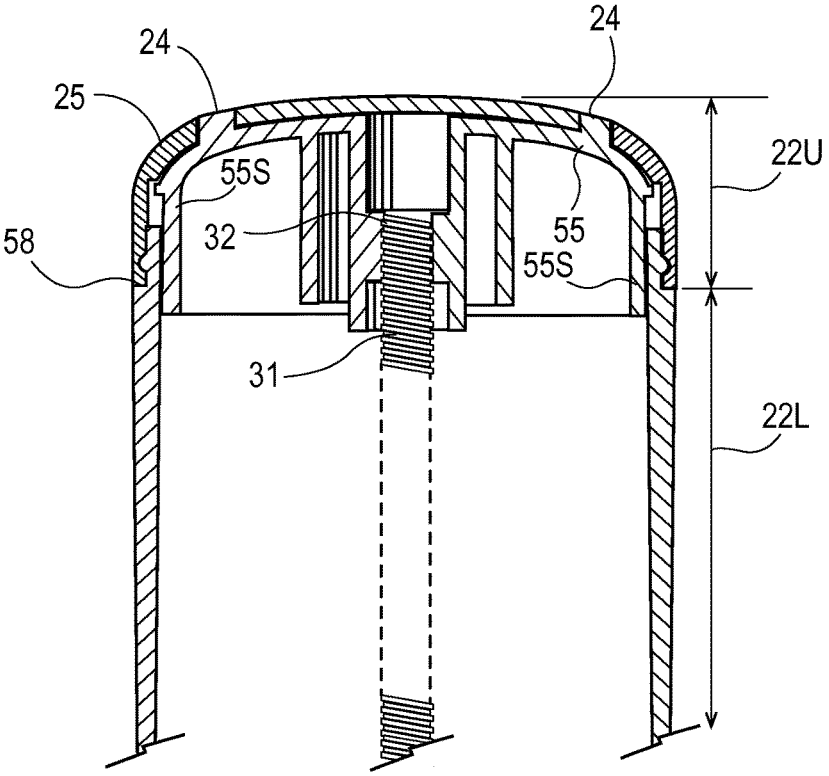
FIG. 4 is a fragmentary vertical sectional view of an alternative embodiment of an aerosol dispenser according to the present invention having an optional longitudinal screw with openings for two valve assemblies, the valve assemblies being omitted for clarity.

Referring to FIG. 4, if desired, the aerosol dispenser may be provided with a longitudinal screw 31. The screw 31 may be coincident the longitudinal axis and be threadably connected to a nut 32. The nut 32 may, in turn be rigidly joined to the piston 55. If desired, high viscosity lubricant may be disposed at the interface between the screw 31 and nut 32 to minimize leakage across the piston 55.

As the piston 55 longitudinally advances under the propellant 40 pressure, the piston 55 simultaneously rotates and axially advances until the piston 55 reaches its final position, as shown. It is prophetically believed that such rotation imparts a swirl to product 42 being dispensed, improved atomization. FIG. 4 also shows that dual valve systems are usable with the aerosol dispenser 20 of the present invention.

Figure 5:
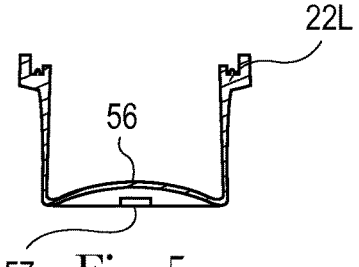
FIG. 5 is an instantaneous vertical sectional view of a lower container portion having a bung hole.

Referring to FIG. 5, if desired, the lower container portion 22L may have a bung hole 56, with a plug 57 or one-way valve, through or juxtaposed with the base. The bung hole 56 provides for filling of the chamber beneath the piston 55 in known fashion. Preferably the lower container portion 22L does not have a bung hole 56, either in the base or lower sidewall portion thereof. Not having a bung hole 56 provides the benefits of eliminating a both leakage path and subsequent plugging operation. Likewise, having the base and sidewalls of the lower container portion integral, e.g. formed from a single piece of material, eliminates another leakage path and subsequent joining operation.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm" and a pressure disclosed as "about 1100 kPa" is intended to include 1103.2 kPa.

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern. All limits shown herein as defining a range may be used with any other limit defining a range. That is the upper limit of one range may be used with the lower limit of another range, and vice versa.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of making an outer container defining an outer container volume therein and being suitable for an aerosol dispenser having a longitudinal axis, said method comprising the steps of:

a. providing a lower container portion with a closed end bottom terminating at a base disposed at a first end, said lower container portion not having a bung hole therethrough;

b. providing an upper container portion having an open neck at a second end, c. completely disposing a piston in said upper container portion wherein said top of said piston is adapted to fit a valve cup and said bottom of said piston has an annular ring for containing propellant therein at the start of dispensing, d. disposing propellant in said lower container portion, where steps c and d are performed in any order, and e. sealably joining said upper container portion and said lower container portion to contain said propellant and said piston therein.

2. A method according to claim 1 further comprising the step of disposing a valve assembly in said neck for selectively dispensing product from said aerosol dispenser.

3. A method according to claim 2 wherein at least one of said upper container portion and said lower container has a channel therethrough or therebetween and said propellant is disposed in said lower container portion through said channel.

4. A method according to claim 3 wherein said upper container portion and said lower container portion both comprise plastic and are joined by welding together at said seal.

5. A method according to claim 4 wherein said channel is sealed by sonic or ultrasonic welding.

6. A method according to claim 5 wherein said channel comprises serrations on an edge of at least one of said upper container portion and said lower container portion.

7. A method according to claim 2 wherein said lower container portion comprises a base and sidewall integral therewith.

8. A method according to claim 7 further comprising the step of disposing a product in said upper container portion through said valve assembly, thereby displacing said piston towards said bottom.

9. A method of making an outer container suitable for an aerosol dispenser and having a longitudinal axis, said method comprising the steps of:

providing a lower container portion with a closed end bottom terminating at a base disposed at a first end, said closed end bottom not having a bung hole therethrough;

providing a domed upper container portion having an open neck at a second end, disposing an axially moveable piston within said upper container portion wherein said top of said piston is concave upwards and adapted to fit a valve cup and said bottom of said piston has an annular ring for containing propellant therein at the start of dispensing, disposing propellant in said lower container portion, sealably joining said upper container portion and said lower container portion together.

10. A method according to claim 9 wherein said piston comprises a top and skirt depending therefrom, said top of said piston being congruent with said dome of said upper container portion.

11. A method according to claim 10 wherein said upper container portion has an axial length and said skirt of said piston has an axial length less than or equal to said axial length of said upper container portion, whereby said piston is entirely disposed within said upper container portion while propellant is being disposed in said lower container portion.

12. A method according to claim 10 further comprising the step of dispensing a product through said upper container portion, thereby forcing said piston towards said bottom of said lower container portion.

13. A method according to claim 12 comprising the step of dispensing product through said upper container portion, until said piston is disposed on said bottom of said lower container portion.

14. A method of making an aerosol dispenser having a longitudinal axis, said method comprising the steps of:

sealably joining a polymeric lower container portion with a closed end bottom at a first end, said closed end bottom not having a bung hole therethrough and comprising a base and sidewall integral therewith to a polymeric upper container portion having an open neck at an opposed second end to yield an outer container, said upper container portion further having an axially moveable piston therein wherein said piston has a top and a skirt, said skirt having an axial skirt length, and said upper container portion has an upper container axial length which is equal to or greater than said skirt axial length and comprising the step of completely disposing said piston within said upper container portion, and disposing a valve assembly in said neck for selectively dispensing product from said aerosol dispenser.

15. A method according to claim 14 further comprising the steps of disposing propellant through a propellant channel through or between at least one of lower container portion and said upper container portion, and disposing a product through said valve assembly, wherein said product is separated from said propellant by said piston.

16. A method according to claim 15 wherein said outer container has a longitudinal dimension defining an axial length, and said seal comprises a circumferential flange disposed proximate with said second end.

17. A method according to claim 16 comprising the step of simultaneously welding said seal and a propellant channel.

* * * * *